US006460220B1

(12) United States Patent
Jackson

(10) Patent No.: US 6,460,220 B1
(45) Date of Patent: Oct. 8, 2002

(54) SPRING HINGE

(75) Inventor: B. Stewart Jackson, Spartanburg, SC (US)

(73) Assignee: Bommer Industries, Inc, Landrum, SC (US)

( * ) Notice: Subject to any disclaimer, the term of this patent is extended or adjusted under 35 U.S.C. 154(b) by 0 days.

(21) Appl. No.: 09/799,242

(22) Filed: Mar. 5, 2001

(51) Int. Cl.[7] ..... E05F 1/14; E05F 1/08

(52) U.S. Cl. ..... 16/285; 16/50; 16/300; 16/304; 16/374; 16/298

(58) Field of Search ..... 16/285, 280, 295, 16/304, 308, 374, 375, 298–301, 75, 76, 50

(56) References Cited

U.S. PATENT DOCUMENTS

| | | | | | |
|---|---|---|---|---|---|
| 40,879 | A | | 12/1863 | Bommer | |
| 637,319 | A | | 11/1899 | Bersted | |
| 1,080,456 | A | | 12/1913 | Katzenberger | |
| 2,520,616 | A | | 8/1950 | Wasson et al. | 16/128 |
| 3,702,491 | A | | 11/1972 | Pelletiere | 16/189 |
| 3,825,973 | A | * | 7/1974 | Gwozdz | 16/300 |
| 3,965,533 | A | | 6/1976 | Frohlich | 16/189 |
| 3,978,551 | A | | 9/1976 | Mochizuki | 16/189 |
| 3,999,246 | A | * | 12/1976 | Suska | 16/273 |
| 4,043,001 | A | | 8/1977 | Parsons | 16/189 |
| 4,073,037 | A | * | 2/1978 | Curry et al. | 16/304 |
| 4,102,013 | A | * | 7/1978 | Newlon | 16/222 |
| 4,339,845 | A | * | 7/1982 | Newlon et al. | 16/300 |
| 4,351,085 | A | * | 9/1982 | Suska | 16/273 |
| 4,353,146 | A | * | 10/1982 | Brockhaus | 16/273 |
| 4,419,788 | A | | 12/1983 | Prout | 16/300 |
| 4,583,262 | A | * | 4/1986 | Werner | 16/300 |
| 4,854,009 | A | * | 8/1989 | Brockhaus | 16/263 |
| 5,048,155 | A | | 9/1991 | Hwang | 16/301 |
| 5,463,795 | A | * | 11/1995 | Carlson et al. | 16/273 |

* cited by examiner

*Primary Examiner*—Chuck Y. Mah
(74) *Attorney, Agent, or Firm*—J. M. Robertson Intellectual Prop, LLC

(57) ABSTRACT

A spring hinge including a pair of hinge leaves having hollow knuckles on adjacent hinges which are arranged in substantially axial alignment such that the hollow knuckles comprise segments of a hinge barrel. A torsion spring made up of a resilient coiled spring member is housed within the hinge barrel. First and second pintles are disposed at opposing ends of the hinge barrel and extend into and between axially aligned knuckles of the hinge leaves. The first and second pintles each engaging the spring member in a locked arrangement such that the spring member extends in a substantially locked relation between the first and second pintles.

19 Claims, 2 Drawing Sheets

SPRING HINGE

TECHNICAL FIELD

This invention relates to a spring hinge, and more particularly to an improved hinge construction incorporating a torsion spring for loading and release during the opening and closure of a door.

BACKGROUND OF THE INVENTION

Spring hinges for urging a door into a normally closed position following opening are well known. Such automatic door closing devices are particularly useful in maintaining doors in a normally closed position to prevent the doors from being left open following use. The maintenance of such a closed position may be desirable in terms of both security and safety in the environment of use.

Spring hinges typically rely upon the loading and subsequent recovery of an internally disposed torsion spring. Due to the fact that individual hinges may be subjected to a variety of conditions so as to require greater or lesser force to achieve closure, it is known to use spring hinge door closing devices which are capable of adjustment to vary the torsional force on the spring and the corresponding force of closure exerted by the spring hinge on the door which it supports. One such prior adjustable spring hinge configuration is illustrated and described in U.S. Pat. No. 4,419,788 to Prout the teachings of which are incorporated herein by reference.

The known spring hinge construction described in U.S. Pat. No. 4,419,788 includes a pair of substantially opposed hinge leaves which are rotatable around a common axis defined by hollow knuckle portions which extend along adjacent edges and which are arranged in substantially axial alignment to form a hinge barrel in which a torsion spring is contained. Pintles located in each end of the hinge barrel extend through and between adjacent knuckles and slidingly engage opposing ends of the torsion spring such that the torsion spring is fixed against rotation relative to a knuckle of each respective hinge leaf A pre-loading torsion force may thus be established and adjusted by locking one pintle in place and thereafter rotating the other pintle relative to the first pintle to load the torsion spring. Once adjustment has taken place, a stop pin is inserted through an opening within the wall of the knuckle disposed in alignment with a pin opening in the adjustable pintle thereby holding the adjustable pintle at a predefined rotational position relative to the knuckle.

Since adjustment of the torsion spring typically takes place in the field, it is desirable to prevent the adjustable pintle from falling out of the hinge barrel prior to or during such adjustment. In the prior known embodiment, the adjustable pintle has been held in place relative to the hinge barrel by a thrust washer secured around a split bushing and disposed at the intersection between the knuckle elements. This combination of split bushings and a corresponding thrust washer thus provides an anti-friction surface between relatively moving metal parts of the door hinge while simultaneously preventing the pintle surrounded by the bushing and corresponding thrust washer from sliding out of the hinge barrel prior to insertion of an appropriate stop pin during adjustment of the torsion spring. The prior art constructions have thus required a relatively complex arrangement of components including multi-piece anti-friction elements which must be maintained in fixed relation to one another in order to carry out the requisite dual functions of friction reduction and containment of internal elements within the hinge barrel.

SUMMARY OF THE INVENTION

This invention provides advantages and alternatives over the prior art by providing a spring hinge assembly of substantially reduced complexity which is not dependent upon a multi-piece bushing and thrust washer assembly to hold the end torsion spring in place within the hinge barrel prior to torsion adjustment. More particularly, the present invention provides a spring hinge assembly in which a torsion spring is engageably locked between pintles such that engagement of one of the pintles at a fixed location within the hinge barrel causes the torsion spring and attached pintles to be retained within the hinge barrel thereby preventing inadvertent sliding removal of the pintles and/or the torsion spring prior to final adjustment of the torsion spring.

According to one aspect of the present invention a spring hinge is provided including a pair of hinge leaves having hollow knuckles on adjacent hinges which are arranged in substantially axial alignment such that the hollow knuckles comprise segments of a hinge barrel. A torsion spring made up of a resilient coiled spring member is housed within the hinge barrel. First and second pintles are disposed at opposing ends of the hinge barrel and extend into and between axially aligned knuckles of the hinge leaves. The first and second pintles each include a spring acceptance opening engaging the spring member such that the spring member extends in a substantially locked relation between the first and second pintles whereby torsion forces are translated between the torsion spring and the pintles. The pintles are held in place relative to the hinge barrel by pin members such that relative movement of the hinge leaves is translated to the pintles and to the torsion spring.

According to one potentially preferred embodiment of the invention a spring hinge is provided including a pair of hinge leaves having hollow knuckles on adjacent hinges arranged in substantially axial alignment such that the hollow knuckles comprise segments of a hinge barrel. A subassembly comprising a resilient torsion spring member of coiled wire with opposing pintles in locked relation at either end is housed within the hinge barrel such that the pintles are disposed at opposing ends of the hinge barrel and extend into and between axially aligned knuckles of the hinge leaves. Preferably, the torsion spring member is held in attached relation between the opposing pintles at the base of a split channel opening extending from the end of each pintle. The split channel opening preferably opens to an increased cross-sectional diameter at the base. The cross-sectional diameter at the base of the split channel opening is preferably slightly larger than the greatest cross-sectional dimension of the coiled wire such that the torsion spring member is not constrictingly pinched while residing at the base. The smaller cross-sectional diameter of the split channel opening below the base permits forced insertion of the wire into the base but substantially prevents manual separation of the spring member from the pintle following such insertion. Pin members hold the pintles in place relative to the hinge barrel such that relative movement of the hinge leaves is translated to the pintles and to the torsion spring.

BRIEF DESCRIPTION OF THE DRAWINGS

The accompanying drawings which are incorporated in and which constitute a part of this specification, illustrate a potentially preferred embodiment of the present invention and together with the general description of the invention given above, and the detailed description set forth below, serve to explain the principles of the invention wherein.

While the invention has been illustrated and generally described above and will hereinafter be described in greater detail in connection with the illustrated and potentially preferred embodiments, it is to be understood that in no event is the invention to be limited to such illustrated and described embodiments. On the contrary, it is intended that the present invention shall extend to all alternatives and modifications as may embrace the principles of this invention within the true spirit and scope thereof.

DESCRIPTION OF THE PREFERRED EMBODIMENT

Figure 1:
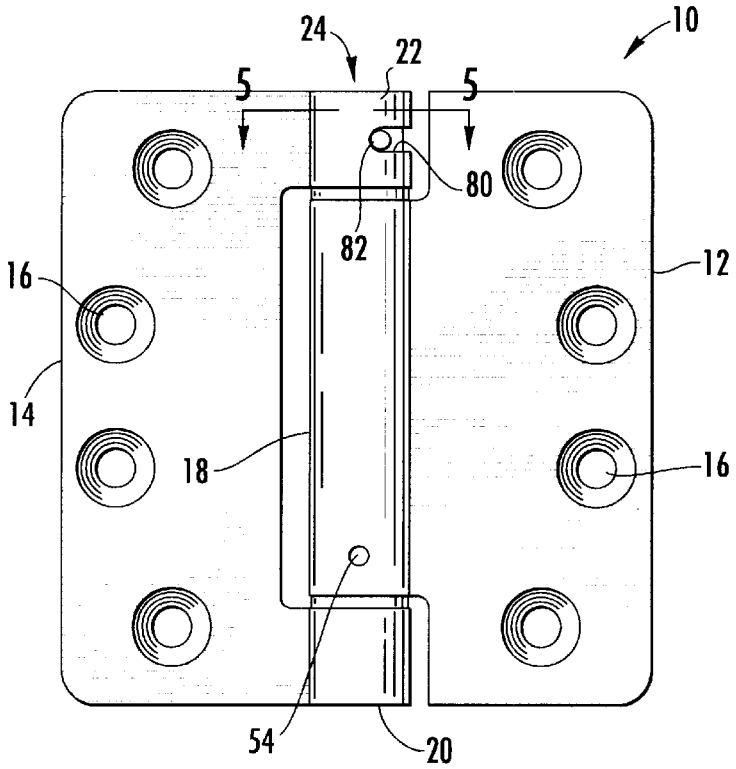
FIG. 1 is a front elevation view of a spring hinge construction according to the present invention.

Turning now to the drawings, wherein to the extent possible like elements have been designated by like reference numerals throughout the various views, in FIG. 1 there is illustrated a spring hinge 10 according to the present invention. As illustrated, the spring hinge 10 includes a first hinge leaf 12 and a second hinge leaf 14. The hinge leaves 12, 14 include screw openings 16 for attachment to a door and a door jam in a manner as will be well know to those of skill in the art. The first hinge leaf 12 preferably includes an elongate central hollow knuckle 18 which is disposed between two spaced end knuckles 20, 22 extending away from the edge of the second hinge leaf 14. As illustrated, the central hollow knuckle 18 and the end knuckles 20, 22 are arranged in axial alignment so as to form a hollow barrel 24 between the hinge leaves 12, 14.

Figure 2:
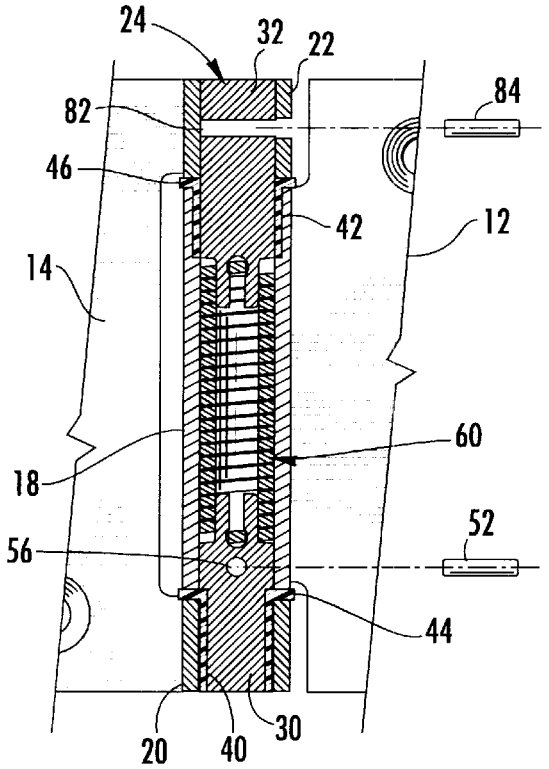
FIG. 2 is a cut-away view of a hinge-barrel portion of a hinge construction according to the present invention.

Referring to FIG. 2, it is seen that a pair of opposing pintles 30, 32 extend into the hinge barrel 24 so as to span the intersection between the central knuckle 18 and respective end knuckles 20, 22. The pintles 30, 32 are preferably of a substantially cylindrical configuration with an outer diameter slightly smaller than the inner diameter of the hinge barrel 24 such that the pintles 30, 32 fit in sliding relation within the hinge barrel 24.

Figure 3:
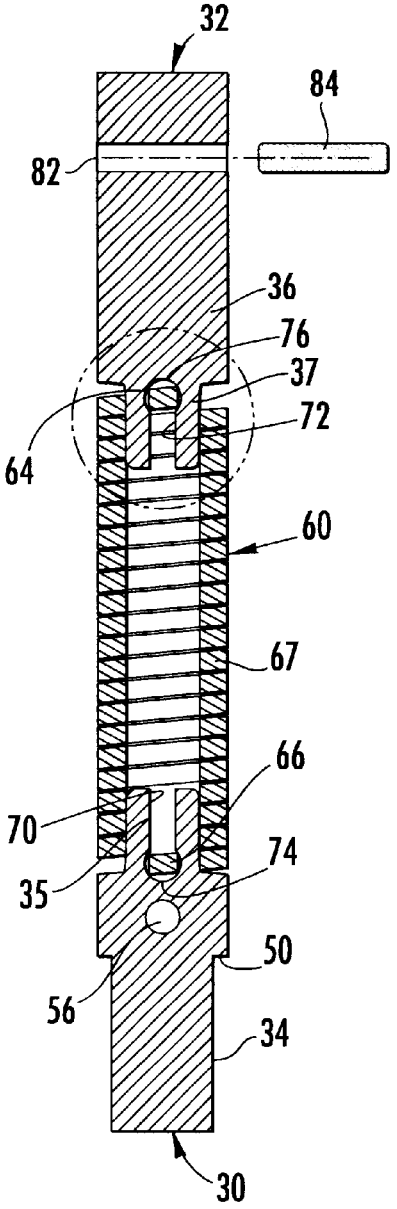
FIG. 3 is an isolated view of a subassembly of the torsion spring and corresponding interlocked pintle members for disposition within the hinge barrel illustrated in FIG. 2.
Figure 4:
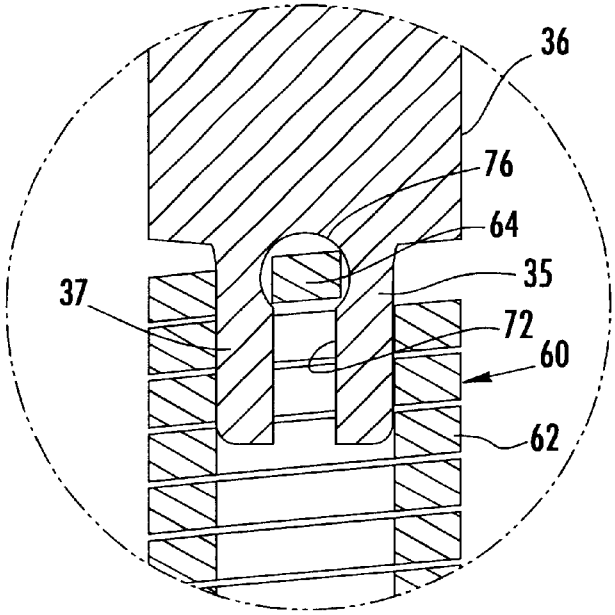
FIG. 4 is an enlarged view of the interlocking relation between the torsion spring and the pintle members as shown in FIG. 3.

As best illustrated in FIG. 3, the first pintle 30 preferably includes a body portion 34 of reduced diameter for insertion within a first substantially sleeve-like friction reducing bushing 40 housed within the lower end knuckle 20 as shown. The first pintle 30 further preferably includes a shoulder stop 50 at which the diameter increases so as to prevent further passage through the first friction reducing bushing 40 such that the shoulder stop 50 rests atop the upper surface of the first friction reducing bushing 40 at a predetermined position along the length of the hinge barrel 24. The second pintle 32 includes a body portion 36 of substantially straight-sided geometry so as to promote substantially smooth uninterrupted insertion into a second friction reducing bushing 42 seated at the upper portion of the central hollow knuckle 18.

Following insertion, the position of the first pintle 30 within the hinge barrel 24 is preferably maintained by insertion of a static fastening pin 52 (FIG. 2) which is received through an aligned opening 54 in the lower wall portion of the central knuckle 18 (FIG. 1) and enters a radial passageway 56 within the first pintle 30. As will be appreciated, through use of this fastening technique the first pintle 30 is secured in place in a substantially fixed longitudinal orientation relative to the hinge barrel 24 while nonetheless being rotatable around the central axis of the hinge barrel 24 upon movement of the first hinge leaf 12.

The hinge leaves 12, 14 and knuckles 18, 20, 22 are preferably made of suitable high strength material, such as low carbon steel, stainless steel, brass, or the like. In order to reduce friction between the end knuckles 20, 22 and the central knuckle 18, the first and second friction reducing bushings 40, 42 are preferably provided with integral collar portions 44, 46 which extend in outward radial fashion between the adjacent knuckles. The body portion of the friction reducing bushings 40, 42 is preferably of a substantially straight cylindrical configuration which terminates at a beveled lower edge to facilitate insertion into the central elongate hollow knuckle 18 and the end knuckle 20 in the manner shown. The outer diameter of the friction reducing bushings 40, 42 preferably corresponds substantially to the inner diameter of the hinge barrel element into which it is inserted. As shown, the second friction reducing bushing 42 which surrounds the adjustable second pintle 32 is preferably housed within a recess within the upper wall of the central knuckle 18 so as to avoid any undue constriction against the rotation of the adjustable second pintle 32 while nonetheless providing a barrier between opposing metal parts. The friction reducing bushings 40, 42 are preferably of a substantially unitary construction formed of a friction induced self-lubricating nylon material or other suitable materials as may be known to those of skill in the art thereby making external lubrication unnecessary.

As shown, the pintles 30, 32 preferably include projecting finger portions 35, 37 for insertion into the interior of a coiled torsion spring 60. The torsion spring 60 is formed by multiple windings of a spring member 62 of resilient character such as spring steel wire or the like. At each end 64, 66 of the torsion spring 60, the spring member 62 is preferably bent in substantially hook-like fashion so as to extend across the interior of the torsion spring 60. The ends 64, 66 of the torsion spring 60 may thereby be received within slotted grooves 70, 72 extending in split relation between the projecting finger portions 35, 37.

The projecting finger portions 35, 37 are preferably formed by cutting the slotted grooves 70, 72 into a substantially cylindrical portion of reduced diameter extending from the ends of the pintles 30, 32. The slotted grooves 70, 72 preferably have a width such that the ends 64, 66 of the torsion spring 60 may be force fit into the slotted grooves 70, 72 resulting in cross-sectional compression until reaching a corresponding base portion 74, 76 of increased diameter. The ends 64, 66 of the torsion spring 60 may thereby be inserted in a substantially snap fit relation into the slotted grooves 70, 72 and held in place at the base portions 74, 76. As illustrated, the diameter of the base portions 74, 76 is preferably slightly greater than the accepted ends 64, 66 of the spring member 62 such that the ends 64, 66 are not constrictingly pinched once insertion is completed. At the same time, the reduced width of the slotted grooves 70, 72 serves to prevent the withdrawal of the ends 64, 66 absent the exertion of substantial force. It is believed that the absence of substantial constriction of the spring member 62 at the base portions 74, 76 permits the ends 64, 66 to move within the base portions 74 76 as necessary to maintain the torsion spring 60 in a substantially axial relation upon the application of a torsion force. Maintenance of such an axial orientation is believed to aid in the avoidance of non-axial kinking in the torsion spring upon application of torque thereby avoiding undue stress concentration which may result in premature damage to the torsion spring.

As previously indicated, the first pintle 30 is preferably held at a substantially fixed position by the static fastening pin 52. Due to the locking relation between the torsion spring 60 and the pintles 30, 32, once the first pintle 30 is secured in place, the attached torsion spring 60 and second pintle 32 are likewise secured against sliding withdrawal from the hinge barrel 24. The second pintle 32 nonetheless remains rotatable within the hinge barrel 24 so as to permit ready adjustment of the torsional force of the attached torsion spring 60.

Figure 5:
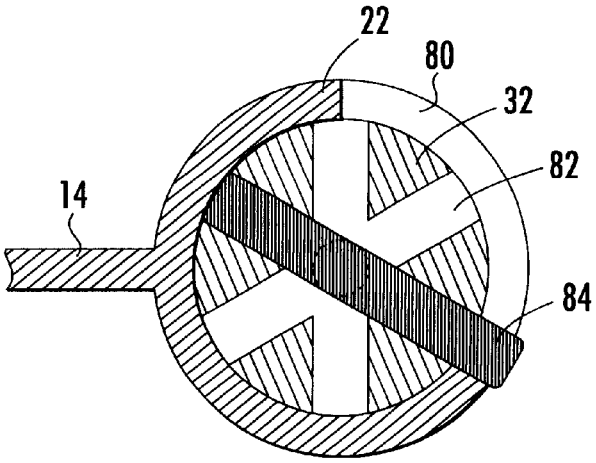
FIG. 5 is a horizontal cross-sectional view taken generally along line 5—5 in FIG. 1.

As best illustrated through simultaneous reference to FIGS. 1 and 5, the end knuckle 22 which surrounds the first pintle 30 is preferably provided with an elongate horizontal slot 80 which extends about the circumference of the end knuckle 22 so as to expose radial passageways 82 within the second pintle 32. As shown, the second pintle 32 is preferably provided with a multiplicity of such radial passageways 82 spaced about the circumference of the pintle which become sequentially aligned with the horizontal slot 80 during rotation of the pintle 30 to expose them for insertion of a loose stop pin 84. The length of the horizontal slot 80 is preferably sufficient to expose three or more radial passageway openings simultaneously such that the pintle 30 may be easily moved by use of a small metal rod or the like inserted into one of the exposed passageway openings 82 and moved along the slot to rotate the pintle in a desired direction and thereby vary the initial torsional force of the torsion spring 60. As will be appreciated, the ability to adjust the torsional force of the torsion spring 60 arises due to the fact that the torsion spring 60 is secured at one end to the previously fixed first pintle 30 which is held in a substantially static position. Thus, rotational adjustment of the second pintle 32 causes a loading of the torsion spring 60. When the desired load has been applied to the torsion spring 60, the loose stop pin 84 is inserted into a passageway opening of the second pintle 32 to lock the second pintle 32 and the torsion spring 60 against counter rotation relative to the end knuckle 22 and the second hinge leaf 14.

The improved spring hinge construction of the present invention may be easily manufactured and assembled from a relatively small number of component parts in comparison to prior hinge constructions. To assemble the spring hinge 10, the knuckles 18, 20, 22 are axially aligned in the manner as illustrated in FIGS. 1 and 2 with the friction reducing bushings 40, 42 in place such that the collar portions 44, 46 extend between the opposing knuckle components. The torsion spring 60 and pre-attached pintles 30, 32 are inserted as a single unit subassembly into the hinge barrel 24 formed by the knuckles 18, 20, 22. Insertion is terminated when the shoulder stop 50 of the first pintle 30 comes to rest atop the radially projecting collar portion 44 of the first friction reducing bushing 40 thereby establishing a predefined position for the torsion spring 60 and attached pintles 30, 32 within the hinge barrel 24. The static fastening pin 52 is press fit into the aligned opening 54 of the knuckle 18 so as to reside in locking relation within the radial passageway 56 of the first pintle 30. No additional assembly is required except that upon installation of the spring hinge 10 in the field, the user may adjust the torsion by rotation of the second pintle 32 and insertion of the loose stop pin 84.

It is, of course, to be understood that a wide range of alternatives and modifications to the embodiment of the present invention as set forth above may exist. Thus, while the present invention has been illustrated and described in relation to potentially preferred embodiments, procedures and practices, it is to be understood that such embodiments, procedures and practices are illustrative only and that the present invention is in no event to be limited thereto. Rather, it is contemplated that modifications and variations embodying the principles of the present invention may occur to those of skill in the art. It is therefore contemplated and intended that the present invention shall extend to all such modifications and variations as may incorporate the broad principles of the present invention within the full spirit and scope thereof.

What is claimed is:

1. A spring hinge comprising:

a pair of hinge leaves having hollow knuckles on adjacent edges arranged in substantially axial alignment such that the hollow knuckles comprise segments of a hinge barrel;

a torsion spring comprising a resilient coiled spring member disposed within the hinge barrel; and a first pintle and a second pintle disposed at opposing ends of the hinge barrel, and extending into axially aligned knuckles of the hinge leaves, the first and second pintles each lockingly engaging the spring member at opposing ends of the spring member such that the spring member extends in substantially axially locked relation between the first and second pintles, whereby torsion forces are translated between the torsions spring and the pintles.

2. The invention as recited in claim 1, wherein friction reducing bushings are disposed between the axially aligned knuckles of the hinge leaves.

3. The invention as recited in claim 2, wherein the friction reducing bushings are self lubricating by friction during relative movement between the axially aligned knuckles.

4. The invention as recited in claim 1, wherein the first pintle includes an annular spacing shoulder for engagement with a blocking structure at a predetermined position along the length of the hinge barrel.

5. The invention as recited in claim 1, wherein one of said first and second pintles includes a plurality of radial passageways having pin receiving openings spaced around its periphery in substantial alignment with a circumferential groove extending at least partially around a knuckle on one of said hinge leaves such that upon the insertion of a retaining pin member into one of the pin receiving openings, said one of said first and second pintles is rotatable about an angle substantially corresponding to the circumferential groove.

6. The invention as recited in claim 5, wherein the other of said first and second pintles includes a radial passageway having a pin receiving opening alignable with a pin opening in the other of said hinge leaves.

7. A spring hinge comprising:

a pair of hinge leaves having hollow knuckles on adjacent edges arranged in substantially axial alignment such that the hollow knuckles comprise segments of a hinge barrel;

a torsion spring comprising a resilient coiled spring member disposed within the hinge barrel; and a first pintle and a second pintle disposed at opposing ends of the hinge barrel, and extending into axially aligned knuckles of the hinge leaves, the first and second pintles each lockingly engaging the spring member at opposing ends of the spring member such that the spring member extends in substantially axially locked relation between the first and second pintles, whereby torsion forces are translated between the torsion spring and the pintles, wherein self lubricating friction reducing bushings are disposed between the axially aligned knuckles of the hinge leaves and wherein the friction reducing bushings are of a substantially single piece construction comprising a collar portion for disposition between adjacent surfaces of the axially aligned knuckles, and a sleeve portion extending away from the collar portion for disposition between the pintles and an interior portion of the hinge barrel.

8. A spring hinge comprising:

a pair of hinge leaves having hollow knuckles on adjacent edges arranged in substantially axial alignment such that the hollow knuckles comprise segments of a hinge barrel;

a torsion spring comprising a resilient coiled spring member disposed within the hinge barrel; and a first pintle and a second pintle disposed at opposing ends of the hinge barrel, and extending into axially aligned knuckles of the hinge leaves, the first and second pintles each including a spring acceptance opening engaging a portion of the spring member such that the spring member extends in substantially locked relation between the first and second pintles and wherein the spring acceptance openings comprise a slot portion having a first cross sectional dimension, the slot portion opening into a base portion of enlarged cross sectional dimension relative to the first cross sectional dimension, such that the portion of the spring member engaged by the spring acceptance opening is supported within the base portion but is substantially restrained against movement out of the base portion and through the slot portion.

9. A spring hinge comprising:

a first hinge leaf including an elongate hollow knuckle disposed along a lateral edge of said first hinge leaf;

a second hinge leaf including a pair of hollow end knuckles disposed along a lateral edge of said second hinge leaf, wherein the elongate hollow knuckle is alignable in substantially axial relation between the hollow end knuckles to form a hinge barrel extending between the first hinge leaf and the second hinge leaf;

a torsion spring comprising a resilient coiled spring member disposed substantially within the hinge barrel; and a locking pintle and an ajustable pintle attached in substantially locking relation to opposing ends of the torsion spring, wherein end portions of the torsion spring are held between projecting finger portions of the pintles such that the torsion spring is secured in substantially locked axial relation between the pintles, the pintles each extending into adjacent axially aligned knuckles of the hinge leaves, the locking pintle being secured in place relative to the hinge barrel to substantially fix the relative axial position of the torsion spring and attached pintles within the hinge barrel and to translate rotational movement of one of said first and second binge leaves to the locking pintle, the adjustable pintle being rotatable relative to the hinge barrel and to the locking pintle to permit adjustment of the torsion spring, the adjustable pintle further being lockable in place following adjustment of the torsion spring such that rotational movement of the other of said first and second hinge leaves is translated to the adjustable pintle and such that relative movement of the hinge leaves is translated to the pintles and to the torsion spring.

10. The invention as recited in claim 9, wherein a first friction reducing bushing extends into one of said hollow end knuckles adjacent a first end of the elongate hollow knuckle, and wherein a second friction reducing bushing extends into the other end of the elongate hollow knuckle.

11. The invention as recited in claim 10, wherein the friction reducing bushings are of a substantially single piece construction comprising a collar portion for disposition between adjacent surfaces of the axially aligned knuckles.

12. The invention as recited in claim 9, wherein the locking pintle includes an annular spacing shoulder for engagement with a blocking structure at a predetermined position along the length of the hinge barrel.

13. The invention as recited in claim 12, wherein the adjustable pintle includes a plurality of radial passageways having pin receiving openings spaced around its periphery in substantial alignment with a circumferential groove extending at least partially around one of said end knuckles on said second hinge leaf such that upon the insertion of a retaining pin member into one of the pin receiving openings, the adjustable pintle is rotatable about an angle substantially corresponding to the circumferential groove.

14. A spring hinge comprising:

a first hinge leaf including an elongate hollow knuckle disposed along a lateral edge of said first hinge leaf;

a second hinge leaf including a pair of hollow end knuckles disposed along a lateral edge of said second hinge leaf, wherein the elongate hollow knuckle is alignable in substantially axial relation between the hollow end knuckles to form a hinge barrel extending between the first hinge leaf and the second hinge leaf;

a torsion spring comprising a resilient coiled spring member disposed substantially within the hinge barrel; and a locking pintle and an adjustable pintle attached in substantially locking relation to opposing ends of the torsion spring, wherein end portions of the torsion spring are held between projecting finger portions of the pintles such that the torsion spring is secured in substantially locked axial relation between the pintles, the pintles each extending into adjacent axially aligned knuckles of the hinge leaves, the locking pintle being secured in place relative to the hinge barrel to substantially fix the relative axial position of the torsion spring and attached pintles within the hinge barrel and to translate rotational movement of one of said first and second hinge leaves to the locking pintle, the adjustable pintle being rotatable relative to the hinge barrel and to the locking pintle to permit adjustment of the torsion spring, the adjustable pintle further being lockable in place following adjustment of the torsion spring such that rotational movement of the other of said first and second hinge leaves is translated to the adjustable pintle and such that relative movement of the hinge leaves is translated to the pintles and to the torsion spring.

15. A spring hinge comprising:

a fist hinge leaf including an elongate hollow knuckle disposed along a lateral edge of said first hinge leaf;

a second hinge leaf including a pair of hollow end knuckles disposed along a lateral edge of said second hinge leaf, wherein the elongate hollow knuckle is alignable in substantially axial relation between the hollow end knuckles to form a hinge barrel extending between the first hinge leaf and the second hinge leaf;

a torsion spring subassembly disposed within the hinge barrel comprising a resilient coiled spring member extending in substantially locked relation between a locking pintle and an adjustable pintle disposed at opposing ends of the spring member wherein the spring member is held in place within a slotted acceptance opening within each of the pintles, the slotted acceptance openings comprising a slot portion opening into an enlarged diameter portion such that the spring member is secured at either end within the enlarged diameter portions but is substantially restrained against movement out of the enlarged diameter portions and through the slot portions, whereby the torsion spring is held in substantially locked relation to the pintles, the pintles each extending into adjacent axially aligned knuckles of the hinge leaves, the locking pintle being secured in place relative to the elongate hollow knuckle to substantially fix the relative axial position of the torsion spring and attached pintles within the hinge barrel and to slate rotational movement of said first hinge leaf to the locking pintle, the adjustable pintle being rotatable relative to the hinge barrel and to the locking pintle to permit adjustment of the torsion spring after the locking pintle is secured in place, the adjustable pintle further being held in place relative to one of said hollow end knuckles following adjustment of the torsion spring such that rotational movement of the second hinge leaf is translated to the adjustable pintle and such that relative movement of the hinge leaves is translated to the pintles and to the torsion spring.

16. The invention as recited in claim 15, wherein a first friction reducing bushing extends into one of said hollow end knuckles adjacent a first end of the elongate hollow knuckle, and wherein a second friction reducing bushing extends into the other end of the elongate hollow knuckle.

17. The invention as recited in claim 16, wherein the friction reducing bushings are of a substantially single piece construction comprising a collar portion for disposition between adjacent surfaces of the axially aligned knuckles.

18. The invention as recited in claim 15, wherein the locking pintle includes an annular spacing shoulder for engagement with a blocking structure at a predetermined position along the length of the hinge barrel.

19. The invention as recited in claim 18, wherein the adjustable pintle includes a plurality of radial passageways having pin receiving openings spaced around its periphery in substantial alignment with a circumferential groove extending at least partially around said one of said end knuckles on said second hinge leaf such that upon the insertion of a retaining pin member into one of the pin receiving openings, the adjustable pintle is rotatable about an angle substantially corresponding to the circumferenteal groove.

* * * * *

UNITED STATES PATENT AND TRADEMARK OFFICE

CERTIFICATE OF CORRECTION

PATENT NO. : 6,460,220 B1
DATED : October 8, 2002
INVENTOR(S) : B. Stewart Jackson It is certified that error appears in the above-identified patent and that said Letters Patent is hereby corrected as shown below:

Column 6,
Line 28, change "torsions" to -- torsion --

Signed and Sealed this

Fourth Day of March, 2003

JAMES E. ROGAN
*Director of the United States Patent and Trademark Office*